United States Patent [19]

Stark et al.

[11] 4,117,529

[45] Sep. 26, 1978

[54] BROKEN RAIL DETECTING TRACK CIRCUITS

[75] Inventors: Donald E. Stark, Mt. Lebanon; Anthony G. Ehrlich, Castle Shannon, both of Pa.; Bruno Guillaumin, Ville d'Avray, France

[73] Assignee: Westinghouse Air Brake Company, Swissvale, Pa.

[21] Appl. No.: 780,474

[22] Filed: Mar. 23, 1977

[51] Int. Cl.[2] ..... H01H 47/20

[52] U.S. Cl. ..... 361/182; 246/34 R

[58] Field of Search ..... 361/171, 172, 182; 340/256; 324/37; 246/34 R, 34 CT

[56] References Cited

U.S. PATENT DOCUMENTS

| | | | |
|---|---|---|---|
| 3,345,511 | 10/1967 | Staples | 246/34 CT |
| 3,450,875 | 6/1969 | Whitten et al. | 246/34 CT |
| 3,524,054 | 8/1970 | Smith | 246/34 R X |
| 4,022,408 | 5/1977 | Staples | 246/34 R |

*Primary Examiner*—Harry E. Moose, Jr.
*Attorney, Agent, or Firm*—A. G. Williamson, Jr.; R. W. McIntire, Jr.

[57] ABSTRACT

Two sensor coils are positioned one adjacent each separate gage rail at the track relay end of a dual gage track section in which train detection current flows in the two gage, i.e., other than common, rails in parallel and returns through the common rail to the energy source. The signal induced in each sensor coil by this track circuit current is applied to a separate receiver broadly tuned to the track circuit frequency. The amplified receiver outputs are applied to a comparator unit which generates an output signal only when the inputs from the receivers are substantially equal as a result of equal other rail currents. The comparator output holds energized a broken rail detector relay which releases to indicate a broken rail condition in the other rails when the sensor coil signals differ by a predetermined amount. If possibility of a shunt fault between the other rails exists, the detector arrangement is supplemented by an audio frequency (AF) circuit in the loop formed by the two other rails in parallel. The comparator detects broken rails if a shunt is close to the coils while the AF detector functions to detect broken rails when a shunt is further from the coils.

19 Claims, 7 Drawing Figures

BROKEN RAIL DETECTING TRACK CIRCUITS

CROSS REFERENCE TO RELATED APPLICATION

Reference is made to the allowed copending patent application Ser. No. 663,516, filed Mar. 3, 1976, by C. E. Staples for Track Circuits With Cab Signals For Dual Gage Railroads, which now U.S. Pat. No. 4,022,408, issued May 10, 1977, has the same assignee as the present application.

BACKGROUND OF THE INVENTION

Our invention relates to broken rail detecting track circuit for railroad track sections in which parallel circuit paths exist for track circuit current. More specifically, the invention pertains to improved circuit arrangements which supplement the normal track circuits for more assuredly detecting broken rails in sections of railroad track having parallel circuit paths, e.g. dual gage track.

Broken rail detection is a desirable feature of any railroad track circuit system. Generally, in the usual two rail track, a conventional track circuit provides broken rail detection which is adequate and reliable. However, under certain conditions, commonly used track circuits do not, without added measures, always detect broken rails. Track sections in which lengths of rail are electrically paralleled present additional and unique problems. For example, dual gage track circuits, as shown in the cited Staples application, utilize the two rails unique to the narrow and wide gages connected in parallel with the common third rail as the return path. A break in one of these two so-called other rails, i.e., not the common rail, is bypassed by current flow in the multipled other gage rail. It has been previously proposed, e.g., the Staples application, to use a separate audio frequency (AF) circuit in the closed loop formed by the two other rails in parallel. Even then, depending upon various track characteristics and parameters, a broken rail may be bypassed by alternate current paths with the possibility of sufficient signal pick up at the receiver to retain a safe condition registry. An economic advantage accrues if the separate AF circuit can be eliminated, at least under favorable conditions, by using the train detection track circuit current in broken rail detection. Another situation which creates similar problems is a guard rail closely spaced along a length of a running rail and which may have electrical bond connections to the running rail at least at each end of the length of guard rail. An even further problem exists where dual gage switches create the possibility of a shunt fault between the two other rails to complicate the detection of a broken rail. A shunt fault may also occur between a running rail and an associated guard rail to cause additional sneak circuit paths which circumvent broken rail detection. A supplemental or modified broken rail detection arrangement is thus needed.

Accordingly, an object of our invention is an improved circuit arrangement for detecting broken rails within a railroad track section.

Another object of the invention is track circuit apparatus for detecting a broken rail within a track section in which lengths of the rails are electrically connected to form parallel circuit paths.

It is also an object of the invention to supplement the train detection track circuit with apparatus to provide broken rail detection for track sections where alternate circuit paths may exist to bypass any broken rails and prevent detection by the regular track circuit.

A further object of the invention is circuit apparatus for a railroad track section, in which rail lengths are electrically connected in parallel, which uses current from the train detector track circuit to also detect broken rails.

Yet another object of our invention is an improved broken rail detection for a dual gage railroad track, utilizing energy already present in the rails for train detection.

It is another object of our invention to provide reliable broken rail detection for a section of track with parallel electric circuit paths in which shunt faults may occur at intermediate points between the paralleled conductors.

A still further object of the invention is a track circuit arrangement for assuredly detecting broken rails in a dual gage track section in which track turnouts exist.

Another object of the invention is broken rail detection circuitry, for a dual gage railroad section with turnouts and track switches, including comparison apparatus actuated by train detector track circuit energy and other apparatus actuated by separate and distinctive AF energy.

Other objects, features, and advantages will become apparent from the following specification and appended claims when taken with the accompanying drawings.

SUMMARY OF THE INVENTION

The basic broken rail detection arrangement disclosed differs from those previously considered in that it uses the current of the train detection track circuit or traction noise current as its signal source. Thus no special transmitter apparatus is required. Although the principles of our invention are applicable to other track circuits where parallel circuit paths through the rails exist, the specific illustration is of dual gage track and such will be used to provide a basis for discussing the principles of our novel circuit arrangement. In the practice of the invention in this context, we place a current sensing means, specifically shown as a pair of receiving coils, at the end of the dual gage track section at which the track relay of the train detector track circuit is located. These coils are positioned between the narrow and wide gage rails with one coil adjacent to and thus coupled with each rail. Each coil is coupled to its associated rail near the direct wire connection coupling these two other rails in parallel which is part of the basic track circuit arrangement shown in the cited Staples application. Each receiving coil responds to current flowing in the adjacent rail to produce an output signal which is individually applied to an associated separate receiver unit. Each receiver unit includes a filter broadly tuned to the frequency of the train detector circuit and an amplifier element. The filter need not exclude every harmonic of the propulsion current. Under normal conditions, track circuit current flows in relatively equal levels in each other rail and in the same relative direction. Thus the outputs developed by the coils are substantially equal and each receiver unit is supplied at the same input level. The receiver amplifier outputs are applied to a comparator unit. With equal inputs, the comparator supplies an output which is processed to energize a broken rail detector relay, which remains picked up to indicate normal conditions, i.e., no broken rail. If either other rail includes a broken length, very little, if any, detector track circuit current flows in that rail. The corresponding receiver coil develops a very low output signal and the associated receiver unit output is greatly reduced. The difference in input signals is detected by the comparator which responds to deenergize the relay which releases to indicate a broken rail condition.

If the dual gage section has a turnout of either gage, the possibility exists of a shunt fault developing between the two other rails. The crossing rails, switch operating rods, etc., are insulated to interrupt such shunt paths but such insulation may break down with use. The previously discussed two receiver, comparator method using the track circuit current may not detect a broken rail if an intervening shunt fault is more than a predetermined distance away. For such sections, we supplement the basic broken rail detection with an AF circuit in the loop formed by the two other rails in parallel. A transmitter having a selected audio frequency, sufficiently above that of the propulsion and track circuit currents, is coupled to the other rails at the track circuit energy supply end. The same receiver coils used in the comparison or differential detection arrangement are used to also produce an AF signal at the other end of the rail loop. However, the coils are connected series-aiding by a separate circuit to a level detector, AF receiver combination which is sharply tuned to the selected audio frequency signals. The output signals of both the comparator unit and the AF receiver are applied to an AND element. When both signals are present, the AND output is processed to energize the detector relay to register the absence of a broken rail. If there is no shunt fault, a broken rail is detected by the comparator network, possibly by both networks, and the relay releases. If a shunt fault occurs between the other rails, and between a rail break and the detector or receiver end, the broken rail is then detected by one or the other network, depending upon such parameters as the shunt impedance, the distance from the shunt to the receiving coils, and the frequency of the AF circuit.

BRIEF DESCRIPTION OF THE DRAWINGS

We shall now describe a specific example of each type of detector arrangement embodying our invention, as applied to dual gage track, and then define the novel features in the appended claims. During the description, reference will be made to the accompanying drawings, in which:

In each figure of the drawings, similar references designate the same or similar parts of the apparatus.

DETAILED DESCRIPTION OF THE ILLUSTRATED EMBODIMENTS

Figure 1:
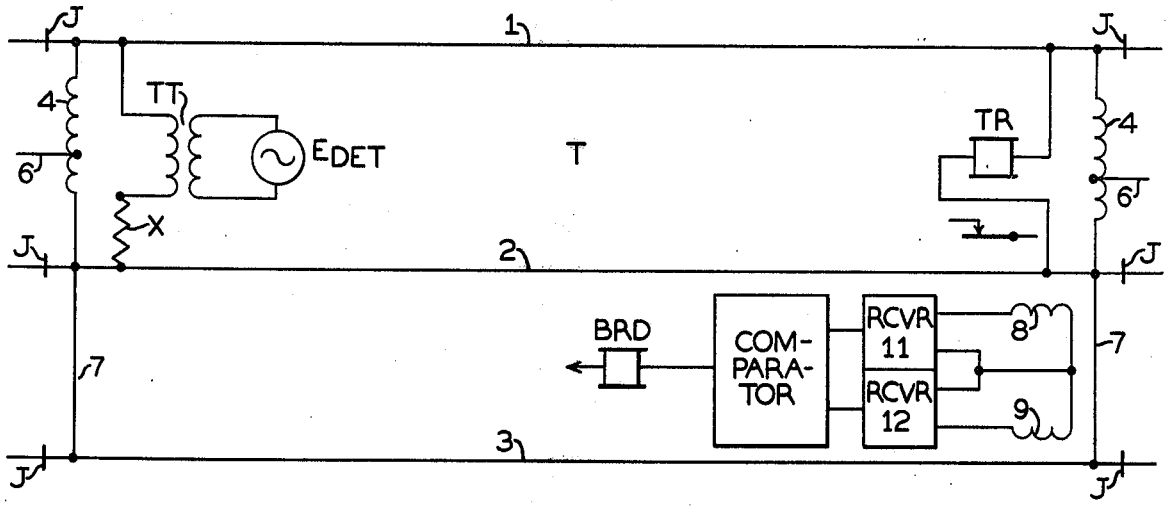
FIG. 1 is a schematic diagram of a track circuit and broken rail detector for a dual gage track section embodying the first form of our invention.

Referring to FIG. 1, a section T of a dual gage railroad is shown. Each of the three rails is shown by a single line symbol, rail 1 being common to both gages, rail 2 being the other rail for the narrow gage, and rail 3 being the other rail for the wide gage. The equal spacing illustrated is for convenience of the drawing and does not indicate actual space relationship between the rails. Obviously, if rail 2 is a guard rail in two rail track, close spacing exists between rails 2 and 3. Each rail section is insulated from the adjoining rail sections by conventional insulated joints designated by the references J. It is assumed that trains of both gages are electrically propelled, either by direct current or commercial frequency alternating current energy. Section T is provided with a train detector track circuit including a source of alternating current energy, shown by a conventional symbol $E_{DET}$, coupled across rails 1 and 2 at the left end by a track transformer TT. As one specific example, to distinguish from the propulsion energy or harmonics from the chopper units used with D. C. propulsion supply, source $E_{DET}$ may have a frequency of 90 Hz. A track relay TR is connected across the same rails at the other end of the section. Although relay TR will normally be of the two winding type, a single winding relay is illustrated for simplicity since the matter is immaterial to the present invention.

To provide a return path through the rails for the propulsion current, an impedance bond winding 4 is connected across rails 1 and 2 at each end of the section. Rails 2 and 3 are connected together by a wire 7 at each end so that they provide parallel electric circuit paths from end to end. Each impedance bond winding 4 is tapped at a preselected point and the tap connected by a lead 6 to the tap on the corresponding impedance bond winding of the adjoining section. This provides for propulsion current return from section to section. Each winding tap is positioned so that the ampereturns developed by the propulsion current in the winding portions balance. In one specific installation, the windings are divided so that 60% of the turns are in the portion connected to rail 1. The track circuit arrangement including impedance bonds is similar to that shown in FIG. 1 of the cited Staples application and reference is made to that case for a complete explanation of the circuit operation.

A predetermined level of broken rail detection is inherent in the track circuit network, e.g., a break in rail 1. However, because of the parallel circuit paths through rails 2 and 3, a break at locations in these rails is bypassed and may remain undetected. The Staples application shows, in its FIG. 4, a supplemental detection means using an AF circuit. It has been discovered, however, that this added arrangement has limited margins under certain possible conditions, due to harmonics in the propulsion current, bypass and leakage circuits, etc. To improve the reliability and margin of broken rail detection, the apparatus of FIG. 1 has been added to the basic track circuit of Staples. It is to be noted that the AF detection circuit of the Staples system is eliminated in this arrangement.

Two sensor devices, shown specifically as receiving coils 8 and 9, are located between rails 2 and 3 at the track relay end of section T. Each coil is positioned to inductively couple with one of the rails and is adjacent to the associated cross connection 7. Flow of current in the adjacent rail then induces energy within the associated coil to produce an output signal. Each sensor or receiver coil is connected to an associated receiver unit, i.e., coil 8 to RCVR 11 and coil 9 to RCVR 12. Each receiver unit comprises a broad band filter and an amplifier stage. The chief function of the filter is to provide satisfactory signal to noise ratio with respect to broad band noise, since strict rejection of propulsion current harmonics is not critical. The two amplifiers need not be critically matched but have similar gain characteristics only. The output signals of the receiver units are applied to a comparator unit to determine, within predetermined limits, that they are equal. The comparator must be of a vital type such as, for example, disclosed in U.S. Pat. No. 3,736,434 issued May 24, 1973 to J.O.G. Darrow for a Fail-Safe Electronic Comparator Circuit. Each comparator block also includes a relay driver element which must be a vital amplifier circuit. This element energizes the broken rail detector relay BRD which may be a standard, vital relay. If desired, the relay may be replaced by a level detector of fail-safe circuit design.

Figure 2:
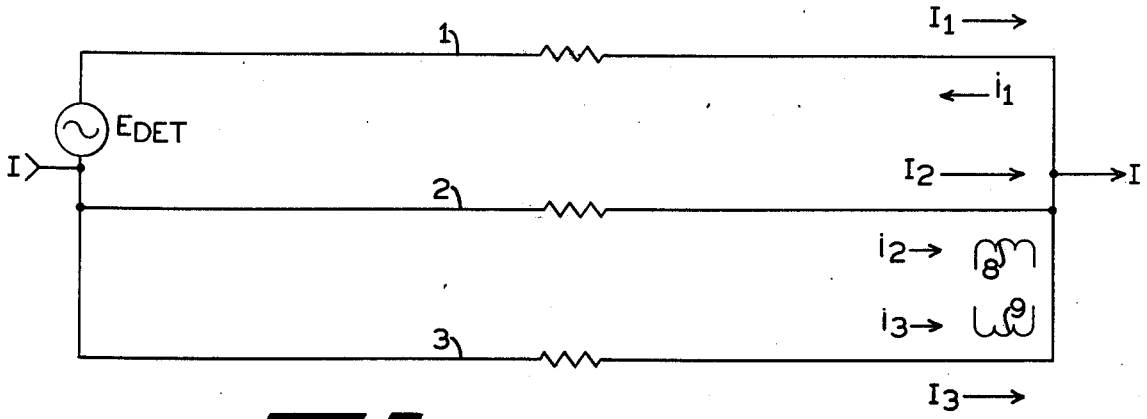
FIG. 2 is a simplified equivalent circuit network for the track circuit, broken rail detector of FIG. 1 under normal conditions.
Figure 3:
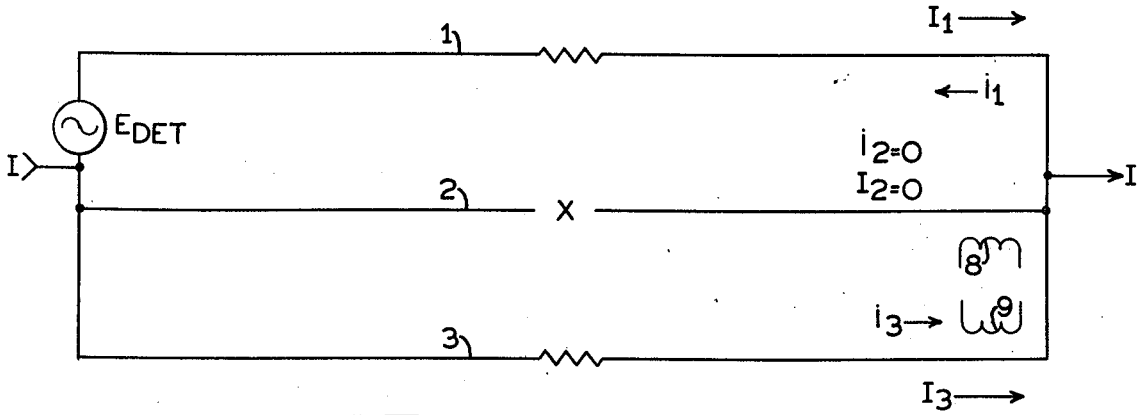
FIG. 3 is a similar simplified equivalent circuit network representing the circuits of FIG. 1 under a broken rail condition.

The operation of the arrangement is illustrated by the equivalent circuits of FIGS. 2 and 3. As shown in these drawings, the source of energy for the broken rail detector is the track circuit supply $E_{DET}$. It is to be noted, therefore, that the broken rail network is operable only when section T is unoccupied. The flow of propulsion current is illustrated by the arrows designated I, with or without subscripts. As an example, such current under the normal conditions of FIG. 2 is assumed to be flowing from left to right but may of course flow in the opposite direction depending upon the location of trains and the propulsion energy source. As illustrated, current I flows from the left through lead 6 into winding 4, divides approximately equally into rails 1, 2, and 3, and flows out to the right through winding 4 and lead 6 at that location. In other words, for all practical purposes of this discussion, $I_1 = I_2 = I_3$. The flow of track circuit current is indicated by the arrows designated i with a numeral subscript relating to the rail. In FIG. 2, current $i_1$ shown flowing to the left at the right end of the rail 1 is the total track circuit current through relay TR and substantially the total current supplied by source $E_{DET}$, differing only by the ballast leakage current between the rails along the length of section T. Since rails 2 and 3 are in parallel (connections 7), track circuit current divides approximately equally between them. Any difference is immaterial to this discussion so that herein it is assumed that, in FIG. 2, $i_2 = i_3$.

With nearly equal propulsion and track circuit currents flowing in rails 2 and 3 (FIG. 2), the sensors or receiving coils 8 and 9 develop equal voltage signals. Each of these is filtered and amplified by the associated receiver unit and applied to the corresponding comparator input. Sensing substantially matched input signals, the comparator responds to generate an output signal to retain relay BRD energized to indicate normal conditions, i.e., no broken rails. The comparator is adjusted to eliminate predetermined minor differences between $i_2$ and $i_3$ due to rail and ballast impedances, and other factors as explained in the Staples application. It is also to be noted that any effects on receivers 8 and 9 by harmonics, ripple surges, etc., in currents $I_2$ and $I_3$ also balance and if passed by the broad band filter of the receiver units, do not unbalance the comparator.

Referring to FIG. 3, an assumed break in rail 2 is indicated by the large X symbol. With no train occupying section T, neither currents $I_2$ nor $i_2$ flow in rail 2 or at least at a greatly reduced level. Receiver coil 8 therefore develops a very low output signal for application through RCVR 11 to the comparator. Coil 9 develops a higher than normal signal, since, from all practical considerations, $i_3$ now equals $i_1$. Since the two inputs to the comparator have a great differential, there is no output signal and relay BRD releases to indicate the broken rail condition. This indication may also be used to adjust approach cab signal or speed control indications to reflect this dangerous condition.

Some track sections such as T may include track turn outs, i.e., a track switch, for trains to enter or leave a secondary track. This may be for either or both gages. The unique character of dual gage track makes the turn out rail a potential shunt between rails 2 and 3. An insulated joint is installed in this turn-out track to effectively interrupt the shunt path but may break down or otherwise fail, creating a rail to rail shunt of varying resistance. In addition, the switch control rods also must be insulated to prevent a similar shunt path. Any shunt fault resulting from the failure of any of this insulation renders the broken rail detection previously discussed less reliable. Our invention supplements the signal comparison arrangement with an AF jointless track circuit in the loop formed by rails 2 and 3. This circuit is similar to that shown in FIG. 3 of the Staples application but is end fed rather than center fed for greater economy in apparatus.

Figure 4:
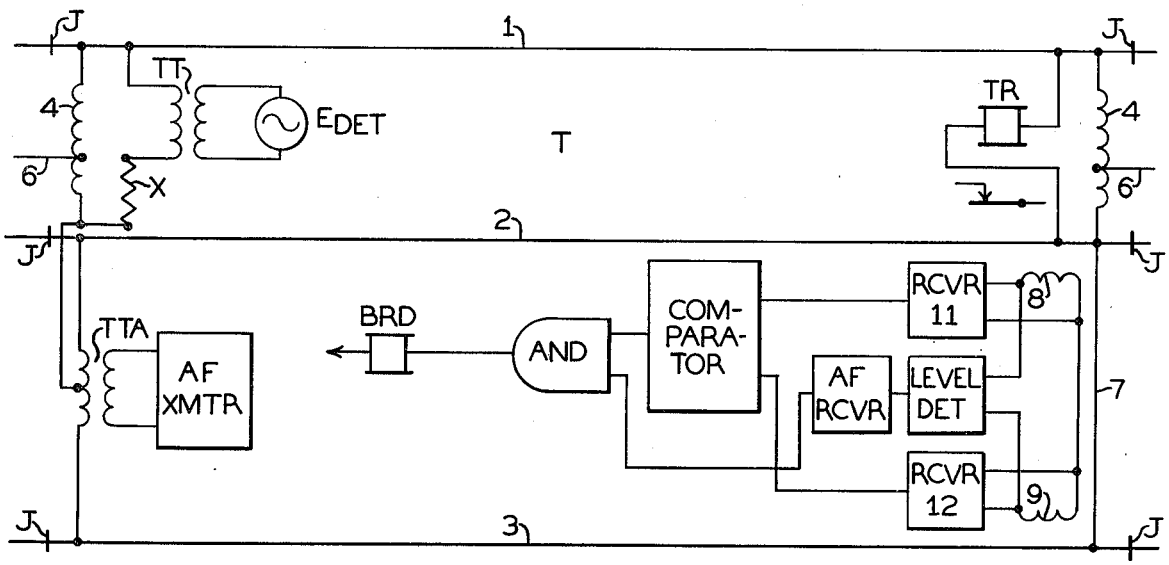
FIG. 4 is another schematic diagram of track circuit and broken rail detection circuits, for a dual gage track section, embodying a second form of the invention.

Referring to FIG. 4, insulated track section T is again shown with rails 1, 2, and 3. The train detector track circut includes source $E_{DET}$ and track relay TR with the associated impedance bonds 4, each with an off center tap connected by lead 6 to the adjacent section bond. At the relay end, the circuit connections are the same as FIG. 1, including wire 7 coupling rails 2 and 3. At the other end, source $E_{DET}$ is coupled through transformer TT with one end of the transformer secondary winding and one end of bond winding 4 connected to rail 1 as in the first arrangement. However, the other ends of these windings, with impedance X in series with the winding of transformer TT, are connected, not to rail 2, but to the midpoint of the secondary winding of an auxiliary track transformer TTA. This secondary winding is connected between rails 2 and 3 to complete the parallel paths through these two rails between the section ends. Transformer TTA also couples the AF transmitter (block AG XMTR) across rails 2 and 3 to supply energy for the supplemental broken rail detection circuit. This unit is illustrated by a conventional block since such apparatus is well known in railroad signaling art and the details are not material. The frequency of the energy supplied to the AF circuit, which includes the loop formed by rails 2 and 3, is in the audio range but is selected well above that of source $E_{DET}$. The use of transformer TTA and its center tapped secondary winding permits the use of the end fed AF rail circuit while maintaining the usual substantial equality of the propulsion current levels in rails 2 and 3.

The sensors or receiving coils 8 and 9 are again positioned adjacent to rails 2 and 3, respectively, in the vicinity of wire 7 at the relay end. Each coil again separate supplies the induced signal to receivers 11 and 12.

Because of the included filter, receivers 11 and 12 respond only to signals of the track circuit frequency ($E_{DET}$) and to any existing harmonics of the propulsion energy in the same range. The outputs of these receivers are, as before, applied to the comparator unit which produces an output signal only when the two input signals are substantially equal, i.e., within predetermined limits.

Coils 8 and 9 are also connected, by different leads, in series aiding relationship through a level detector unit to the AF receiver (AF RCVR). The level detector block (LEVEL DET) includes a filter circuit sharply turned to the frequency of the AF transmitter so that response by the receiver is only to signals of that frequency induced in coils 8 and 9. The level detector fixes the pick up and release voltage levels for the AF receiver network. The AF receiver unit includes an amplifier element and, when a signal of proper frequency and level is applied, supplies an output signal to one input of and AND circuit indicated by a conventional symbol. The second input to the AND circuit is from the comparator unit of the other detector network. When both detection signals are present, the resulting output of the AND circuit energizes the broken rail detector relay BRD.

Figure 5:
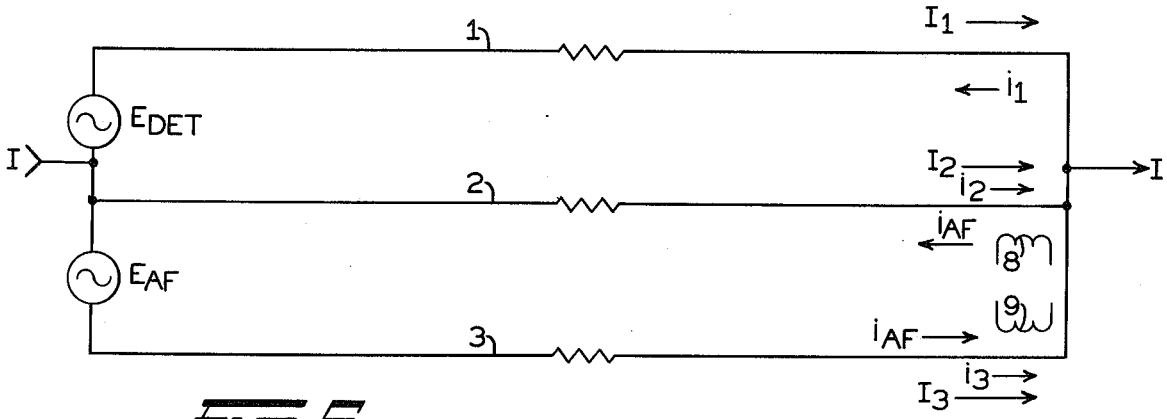
FIG. 5 is a simplified equivalent circuit network for the track circuit and broken rail network of FIG. 4 under normal conditions.

The operation of this supplemented detection arrangement under normal conditions is illustrated in the equivalent circuit network of FIG. 5. The energy sources for the train detector track circuit and the AF track circuit are indicated by the conventional symbols designated $E_{DET}$ and $E_{AF}$, respectively. The flow of propulsion current is indicated by the arrows designated by he symbol I with subscripts. An assumed direction is shown but under other conditions, all such currents may be reversed. Also as before, the flow of train detection track circuit current is indicated by the arrows $i_1$, $i_2$, and $i_3$. The return current $i_1$ is the total detection current flow but such current divides between rails 2 and 3 with $i_2$ being approximately equal to $i_3$. The rail current of the AF circuit is designated by the arrows $i_{AF}$. This current normally flows in the loop comprising rails 2 and 3 and their coupling leads and is supplied by transmitter source $E_{AF}$.

With normal conditions, and section T unoccupied, receivers 11 and 12 are supplied with relatively equal signals from coils 8 and 9, respectively, due to currents $i_2$ and $i_3$, and the comparator supplies a first signal to the AND circuit. The combined signal from coils 8 and 9 due to current $i_{AF}$ flowing in opposite directions in rails 2 and 3 is passed through the level detector to the AF receiver. This unit responds to supply a second signal to the AND circuit. This results in an output which holds relay BRD energized to indicate the absence of any broken rails.

Figure 6:
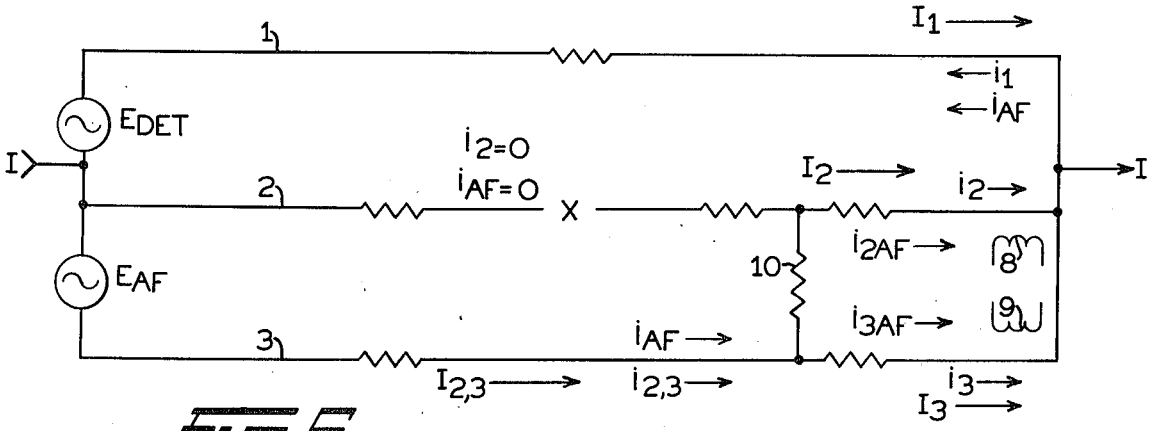
FIG. 6 is a simplified equivalent circuit network for the track circuit and broken rail detection network of FIG. 4 illustrating broken rail and shunt fault conditions.

The equivalent circuit network of FIG. 6 represents the operation when a rail break X exists in rail 2 and a shunt fault 10 occurs between rails 2 and 3 to the right of the break, that is, between the break and the detector receivers. Shunt 10 may be caused by insulation breakdown in a turn-out rail or a switch operating rod and will have variable resistance, which is illustrated by the conventional symbol. With section T unoccupied, the flow of the various rail currents is shown by the arrows. Propulsion current I flows primarily in rails 1 and 3, although some part of current $I_{2,3}$ will flow through shunt 10 into rail 2 and thence to the right end. Similarly, to the left of the shunt, very little if any train detector rail current flows $8i_2 = 0$) and $i_{2,3}$ in the left portion of rail 3 is substantially equal to $i_1$, i.e., the full track circuit current. Current $i_{2,3}$ divides at the shunt and a portion flows through shunt 10 and thence through rail 2, the level depending upon the impedance. In other words, the ratio of currents $i_2$ and $i_3$ to the right of the shunt is determined by the impedance of the shunt and the impedance of the rails to the right. If the shunt is of low impedance, or at a considerable distance from the right end of section T, $i_2$ and $i_3$ may be sufficiently matched to cause the comparator to produce an output signal. Therefore, by itself, the comparator of differentiation arrangement may not detect a broken rail under such conditions.

With the conditions of FIG. 6, current $i_{AF}$ flows through rail 3 from source $E_{AF}$ but must now return through rail 1, as indicated by the arrow $i_{AF}$. Current $i_{AF}$ also divides at shunt 10 and follows the parallel paths through rails 2 and 3. Again the value of the shunt impedance and the impedance of the portion of rail 2 fixes the level of current $i_{AF}$. With both $i_{2AF}$ and $i_{3AF}$ flowing in the same direction, the signal in coil 8 opposes that of coil 9, that is, the two induced voltages are of opposing instantaneous polarity. If the two currents are of the same order, even though not of exactly equal level, the level detector passes no signal and the AF receiver produces no output. However, if the shunt is quite close to the receiver coils and/or is of high impedance, current $i_{2AF}$ is at a very low level and the output of coil 9 sufficiently overrides that of coil 8 to actuate the AF receiver and broken rail detection is lost.

Figure 7:
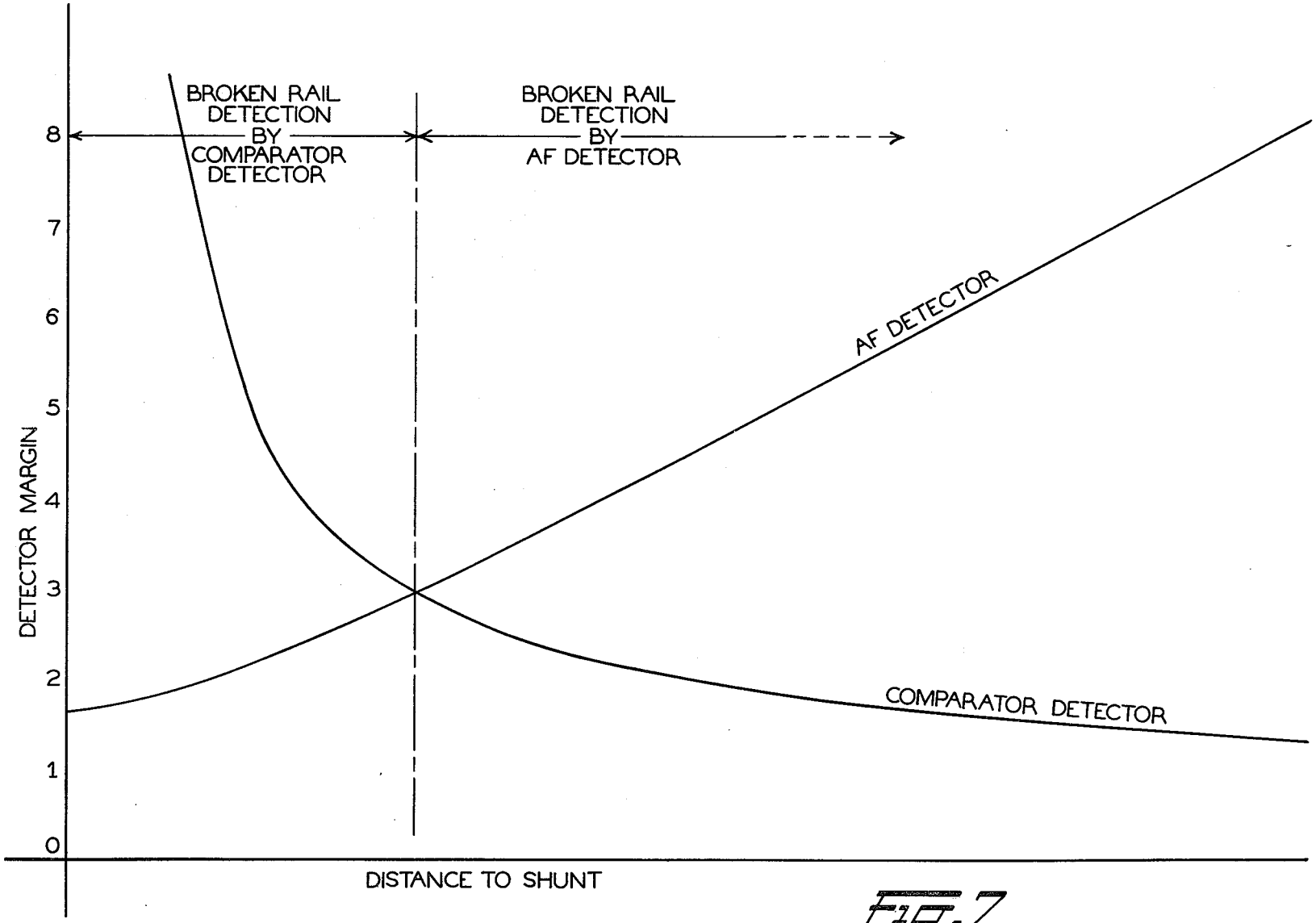
FIG. 7 illustrates graphically the relationship between the operation of the two specific detection elements of the arrangement of FIG. 4.

Using the entire broken rail detection arrangement of FIG. 4, and with proper selection of controllable circuit elements, receiver sensitivities, and circuit frequencies, the apparatus is capable of detecting a broken rail at any location within section T, even though a shunt fault has occurred between the break and the detector receivers. When one or the other detection network halts its output, the AND circuit responds to deenergize relay BRD to indicate a broken rail condition in rail 2 or 3. FIG. 7 shows, in chart form, a typical division of broken rail detection between the comparator and AF detectors to provide a satisfactory and reliable margin of detection. It is to be noted that, as the distance of the shunt from the receiver coils increases, a changeover point is reached where the AF detector replaces the comparator arrangement in providing a better margin of detection. The curves of FIG. 7 are an example for a constant assumed shunt impedance and a selected audio frequency. As the shunt impedance increases, the comparator margin increases, other factors remaining the same. The opposite characteristic is true of the AF detector. Further, as the audio frequency is increased, the slope of the AF curve becomes greater, i.e., there is more margin at greater distances. There is no corresponding characteristic for the comparator system as it uses the track circuit frequency which is fixed throughout any one installation, generally at the commercial power frequency or at a frequency easily obtainable from the commercial frequency. Such changes in the parameters obviously shift the boundary between the zones in which each type detector provides the better margin.

The basic circuit arrangement of our invention thus provides an assured method of detecting a broken rail in either of two rails electrically connected in parallel through a track section having a train detection track circuit. It eliminates the need for a separate and distinct detection circuit with its own separate energy source, e.g., an AF transmitter. Since the basic system measures and compares the flow of current in the same direction in the two paralleled rails, harmonics of the propulsion current in the rails do not interfere. Where there is a possibility of a shunt fault between the paralleled rails at the same time that a broken rail may occur, the invention supplements the basic system with a separate AF detection circuit. With proper selection of the circuit parameters, the two detectors complement each other so that detection of any broken rail is assured even if a shunt between the two paralleled rails exists between the break and the detectors. The system of our invention therefore provides an effective, efficient, and economic arrangement which assures the detection of a broken rail.

Although we have herein shown and described but one basic embodiment of our invention and one principal modification thereof, it is to be understood that various other changes and modifications within the scope of the appended claims may be made without departing from the spirit and scope of our invention.

Having thus described our invention, what we claim as new and desire to secure by Letters Patent, is:

1. A circuit network for detecting broken rail in an insulated track section including two rails extending between the section ends and a length of another rail electrically coupled in parallel to at least a portion of one of said section rails, comprising in combination, (a) a source of energy coupled to said section rails at one end for transmitting train detection current through said section rails, (1) said train detection current dividing at substantially equal levels between said portion of said one rail and said other rail when normal rail conditions exist through said paralleled rail paths, (b) sensing means coupled to said one rail and said other rail at the end of said parallel circuit portion distant from said source for producing a pair of voltage signals, one associated with each parallel rail and representative of the current level flowing in that rail, (c) a comparator means coupled to said sensing means for receiving said pair of signals produced thereby and responsive only to substantially equal received signals for generating an output signal, and (d) a registry means coupled to said comparator means and responsive to an output signal for registering the absence of any broken rail in said portion of said one rail and in said other rail, said registry means registering a broken rail condition when no output signal is received from said comparator means.

2. A circuit network for detecting broken rail as defined in claim 1 in which said sensing means comprises, (a) a pair of receiving coils, one positioned adjacent each of said one rail and said other rail at the end of the parallel portion distant from said source, for inductively receiving a signal when current flows in the associated rail, and (b) a signal receiver means associated with each receiving coil, each coupled for receiving the induced signal from that coil and for transmitting an amplified signal to said comparator means.

3. A circuit network for detecting broken rail as defined in claim 2 in which, said comparator means is a vital, fail-safe voltage comparator circuit network.

4. A circuit network for detecting broken rail as defined in claim 3 in which, said registry means is a vital relay energized by said voltage comparator network output to indicate the absence of a broken rail and indicating a broken rail condition in one of said two rails when deenergized and in its released position.

5. A circuit network as defined in claim 4 in which, said other length of rail is a guard rail placed immediately adjacent a portion of said one rail and electrically connected at each end to said one rail.

6. A circuit network for detecting broken rail as defined in claim 4 in which, said other length of rail is a third rail of a dual gage track connected at each end of said section to said one rail.

7. A broken rail detection arrangement for a section of dual gage railroad track, including a common rail and two individual gage other rails, said other rails being coupled at each end of the section to form parallel electrical circuit paths between the section ends, comprising in combination, (a) a source of train detection energy having a preselected frequency and coupled at one end of said section between said parallel circuit path and said common rail for transmitting current in the same direction in each other rail, normally at substantially equal levels, with a return circuit path through said common rail, (b) sensing means inductively coupled to said other rails at the other end of said section and responsive to rail currents from said source for producing a pair of substantially equal signals only when train detection rail currents flow in a normal pattern, said signals being unequal if a broken rail in either other rail interrupts the normal equal current flow in said other rails, (c) comparator means coupled for individually receiving said pair of signals from said sensing means and responsive thereto for generating an output signal only when the received signals are substantially equal, and (d) registry means connected to said comparator means for indicating the absence of a broken rail condition in said other rails when said output signal is present and indicating a broken rail condition in response to the absence of an output signal.

8. A broken rail detection arrangement as defined in claim 7, in which said sensing means comprises, (a) a pair of receiving coils, one positioned adjacent each other rail at said other end of the section for inductively receiving a signal when current flows in the associated rail, and (b) a signal receiver means associated with each receiving coil, each coupled for receiving the induced signal from that coil and for transmitting an amplified signal to said comparator means, (1) each receiver means tuned to respond only to signals induced by rail currents of the frequency range of said train detector source.

9. A broken rail detector arrangement as defined in claim 8, in which, said comparator means is a vital, fail-safe voltage comparator circuit network.

10. A broken rail detection arrangement as defined in claim 9, in which, said registry means is a vital relay energized by said voltage comparator output to indicate absence of a broken rail and indicating a broken rail condition when deenergized and in its released position.

11. A broken rail detection arrangement as defined in claim 7, which further includes, (a) another energy souce having a distinctive frequency characteristic coupled at said one end into a closed rail loop circuit formed by the parallel coupled other rails for transmitting a current having said distinctive frequency through said loop circuit, (b) an AND circuit network having two inputs and coupled between said comparator means and said registry means for receiving one input from said comparator means output and for supplying its own output signal when present to said registry means, (c) said sensing means also being responsive to rail current of said distinctive frequency for producing a separate output signal and further coupled for supplying said separate signal as a second input to said AND circuit network, and (d) said AND circuit network supplying an output signal to said registry means, for indicating the absence of any broken rail condition, only when both inputs are received.

12. A broken rail detection arrangement as defined in claim 11, in which said sensing means comprises, (a) a pair of receiving coils, one positioned to inductively couple with each other rail for receiving signals when current flows in the associated rail, (b) a separate signal receiver means individually coupled to each receiving coil and to said comparator means and responsive only to signals induced in the associated coil by current supplied by said train detection source for supplying an amplified signal to said comparator means, and (c) another common receiver means coupled to both coils in series aiding and to said AND circuit and responsive only to signals induced by current of said distinctive frequency for supplying a second input to said AND circuit network.

13. A broken rail detector arrangement as defined in claim 12, in which, said comparator means is a vital, fail-safe voltage comparator circuit network.

14. A broken rail detection arrangement as defined in claim 13, in which, said registry means is a vital relay energized by said AND circuit network output to indicate absence of a broken rail and indicating a broken rail condition when deenergized and in its released position.

15. A broken rail detection arrangement as defined in claim 14 which further includes, (a) a first and a second track transformer, each having a primary and a secondary winding, said second transformer secondary winding having a center tap, (b) said second transformer secondary winding connected across said other rails at said one end for coupling said other rails in parallel, said rail loop being completed by a direct connection at said other end, (c) said other energy source connected to said second transformer primary winding for coupling into said rail loop formed by said other rails connected in parallel for transmitting said distinctive frequency current through said loop, (d) said train detection source connected to said first transformer primary winding, (e) said first transformer secondary winding connected between said common rail and said secondary transformer secondary winding tap for coupling said train detection source across said common rail and said other rails in parallel for transmitting train detection current at substantially equal levels in said other rails with a return path through said common rail.

16. A broken rail detection arrangement as defined in claim 15 in which, (a) said other energy source is an audio frequency transmitter for transmitting a preselected audio frequency current through said rail loop, (b) said common signal receiver means is tuned for responding only to signals of said preselected audio frequency.

17. In combination with a train detector track circuit for a section of dual gage railroad track including a common rail and a separate other rail for each gage, said other rails electrically coupled to form a parallel path end to end of said section for the track circuit current supplied by a source of energy, coupled at one end of said section between said common rail and said other rails in parallel, to a track relay similarly coupled at the other end, (a) sensor means coupled to said other rails at said other end and responsive to track circuit current flowing in said other rails for producing a separate signal respresentative of the current in each other rail, (1) said produced signals being substantially matched when substantially equal currents flow in each other rail under normal track conditions, (b) a receiver means coupled for separately receiving said signals from said sensor means and operable for generating an amplified output signal for each input signal, substantially equal when said sensor means signals are matched, (c) comparator means coupled for receiving both said receiver means output signals and responsive thereto for generating an output only when said received signals are matched within predetermined limits, and (d) a broken rail registry means coupled for receiving said comparator output and responsive to the presence and absence of a signal for indicating the absence or presence, respectively, of a broken rail in said other rails within said section.

18. The combination as defined in claim 17 in which, (a) said sensor means comprises a pair of receiver coils inductively coupled one to each other rail at said other end for producing a voltage signal in response to track current flowing in the associated rail, and (b) said registry means is a relay connected to be energized by said comparator means output for registering the absence of a broken rail, said relay registering the presence of a broken rail when deenergized.

19. The combination as defined in claim 17 which further includes, (a) an audio frequency transmitter means coupled across the other rails at said one end for transmitting a selected signaling current through the loop formed by said other rails in parallel, (b) an audio frequency receiver means separately coupled to said sensor means at said other end for receiving signals produced in response to rail currents and responsive only to signals induced by said selected rail current for generating an output signal, and (c) an AND circuit coupled for receiving inputs from said comparator means and said audio frequency receiver means when corresponding output signals are generated, (d) said AND circuit responsive only when both inputs are received for producing in turn an output signal, (e) said AND circuit further coupled for supplying its output signal to said registry means to register the absence or presence of a broken rail as said output signal is present or absent, respectively.

* * * * *